United States Patent [19]

Brand

[11] Patent Number: 4,667,599

[45] Date of Patent: May 26, 1987

[54] EXPLOSIVE CUTTING DEVICE WITH SIMULTANEOUS DETONATION OF OPPOSITE ENDS

[75] Inventor: Douglas Brand, Aberdeen, United Kingdom

[73] Assignee: C-E Vetco U.K. Limited, Hayes, England

[21] Appl. No.: 726,324

[22] Filed: Apr. 23, 1985

[30] Foreign Application Priority Data

Apr. 26, 1984 [GB] United Kingdom ..... 8410631

[51] Int. Cl.[4] ..... C06C 5/04

[52] U.S. Cl. ..... 102/275.4; 102/275.5; 102/275.9; 102/275.6; 102/313; 102/275.7; 102/318; 102/275.8; 102/275.11; 102/275.12

[58] Field of Search ..... 102/275.3, 275.4, 275.6, 102/275.7, 275.8, 275.9, 275.11, 275.12, 312, 313

[56] References Cited

U.S. PATENT DOCUMENTS

| | | | |
|---|---|---|---|
| 3,336,869 | 8/1967 | Peterson et al. | 102/275.3 |
| 3,838,643 | 10/1974 | Austin et al. | 102/24 |
| 4,166,418 | 9/1979 | Calder, Jr. | 102/275.3 X |
| 4,184,430 | 1/1980 | Mock | 102/313 X |
| 4,290,486 | 9/1981 | Regalbuto | 102/312 X |
| 4,314,508 | 2/1982 | Love | 102/275.3 X |
| 4,425,849 | 1/1984 | Jorgenson | 102/202.12 X |
| 4,527,482 | 7/1985 | Hynes | 102/275.5 X |

FOREIGN PATENT DOCUMENTS

| | | |
|---|---|---|
| 657763 | 9/1951 | United Kingdom . |
| 1046655 | 10/1966 | United Kingdom . |

*Primary Examiner*—Peter A. Nelson

*Attorney, Agent, or Firm*—Leydig, Voit & Mayer

[57] ABSTRACT

A device for parting or cutting a tube by means of an explosive charge, comprising a pack of explosive annular pellets 20 and a fuse assembly. The fuse assembly comprises two mutually equal lengths of detonating fuse 10 and 11 of which one 10 extends axially through the said pack 20 and the other 11 is disposed at one end of the said pack 20. Fuse 10 extends between a first booster 17 adjacent to but not contiguous with said one end of the pack 20 and a second booster 18 at the other end of the pack 20, and fuse 11 extends between said first booster 17 and a third booster 19 at said one end of the pack 20. In this way the pack 20 is sandwiched between said second and third booster and simultaneous detonation of the pack 20 at its opposite ends is achieved, when required in use, by application of a single initiation system to the first booster 17.

8 Claims, 2 Drawing Figures

EXPLOSIVE CUTTING DEVICE WITH SIMULTANEOUS DETONATION OF OPPOSITE ENDS

Figure 1A:
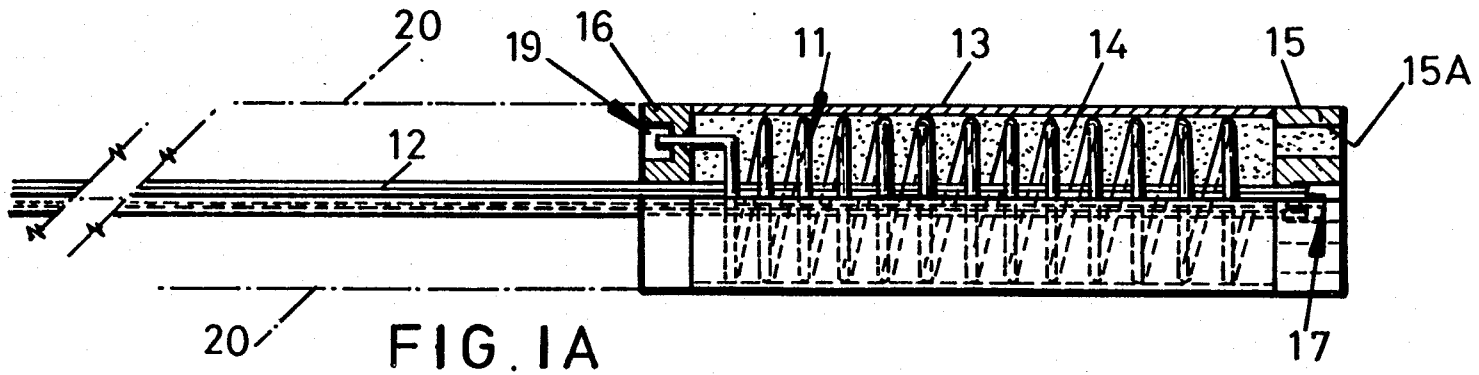

This invention relates to a device for parting or cutting a tube by means of an explosive charge; and to a method of assembling such a device.

It is known to effect explosive parting or cutting of a tube by placing therein and detonating an explosive charge of cylindrical configuration. In order to match the size of the explosive charge generally with the tube, having regard to the size and material thereof, it is conventionally the practice to regard the nominal diameter of the explosive charge as one of the standard variables. Also, in conventional practice, detonation of the charge is effected simultaneously at each end thereof by an appropriately divided initiation system.

The conventional practice outlined above has disadvantages of which one is a limitation on the range of charge sizes available having a specified, and relatively small, nominal diameter. Thus, there has been a limitation on the "cutting power" of previous small-diameter charges. Further, previous proposals to employ small diameter charges of greater length have suffered the disadvantage that the fuse assemblies therefor were troublesome to adapt to cuts calling for smaller charges.

Also, with on-site setting of a divided initiation system, there exists a greater risk of imperfectly synchronised detonations at the opposite ends of the charge, with an attendant risk of an unsuccessful attempt to part or cut due to failure to develop full explosive force in the lateral plane at the centre of the charge.

An object of the present invention is to provide a device for parting or cutting a tube by means of an explosive charge, and a method of assembling such a device, whereby the mentioned disadvantages are obviated or mitigated.

According to the present invention, there is provided a device for parting or cutting a tube by means of an explosive charge, comprising an outer tubular casing, a pack of explosive annular pellets in the casing, and a fuse assembly in the casing and having two mutually equal lengths of detonating fuse of which one extends axially through the said pack and the other is disposed at one end of the pack, said one fuse extending between a first booster adjacent but not contiguous with said one end of the pack and a second booster at the other end of the pack, said other fuse extending between the first and a third booster at said one end of the pack, whereby simultaneous detonation of the pack at its opposite ends is achieved, when required in use, by application of a single initiation system to said first booster.

Preferably, said other detonating fuse is arranged in an open-coiled helix configuration.

Preferably, the fuse assembly comprises a relatively short tube housing said helix, and a relatively long tube extending through and beyond the short tube and carrying said one fuse.

Preferably, the second and third boosters are carried by respective clamp members of disc-like configuration and adapted to be located on said relatively long tube.

Further, according to the present invention, there is provided in a method of assembling a device as aforesaid, the steps of making a fuse assembly comprising two mutually equal lengths of detonating fuse of which one is carried in a relatively long tube and the other is disposed in open-coiled helical configuration in a relatively short tube at one end portion of the relatively long tube, said one fuse extending from a first booster at an outer or free end of the relatively short tube and having its other end free, a second booster carried by a clamp member locatable at positions spaced along the relatively long tube, said other fuse extending between said first booster and a third booster at an inner end of the relatively short tube, disposing a pack of explosive annular pellets axially on the relatively long tube and locating said clamp member to retain said pack, and inserting said other end of said one fuse into said second booster.

Further, according to the present invention, there is provided the fuse assembly as aforesaid.

We propose to reduce the extent to which the size of an explosive charge, in the present context, is determined with reference to its diameter. Thus, with the charge length as the principal variable, the charge size is determined solely in terms of the number of annular pellets of explosive used. This approach allows a single or relatively few "standard" fuse assemblies to serve a wider range of charge sizes. Also, where charge length is the principal variable, generally this dimension tends to be greater than hitherto so placing greater need for precision in detonation synchronisation. By using workshop or factory made fuse assemblies with mutually equal length detonating fuses, on-site initiation is relieved of the need to operate with the precision required. Thus, greater reliability of performance is achieved.

Figure 1B:
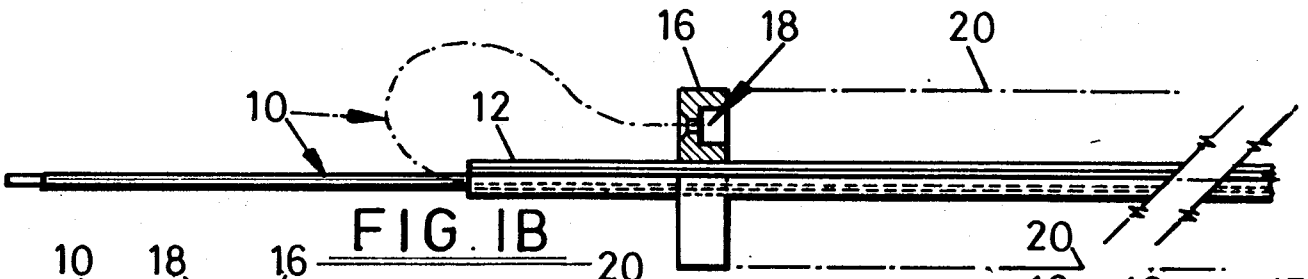
Figure 2:
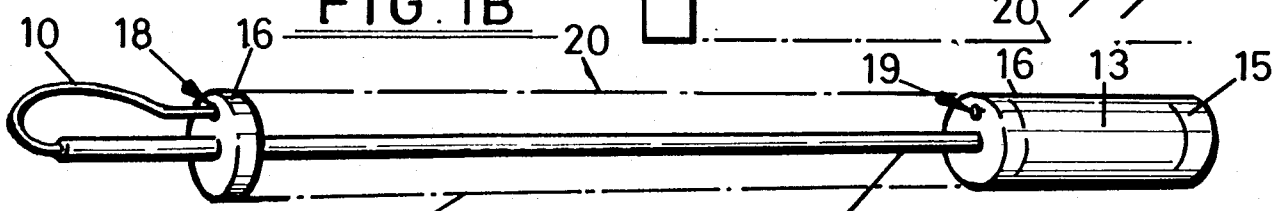

An embodiment of the present invention will now be described, by way of example, with reference to the accompanying drawings in which:

FIGS. 1A and 1B taken together show a partial sectional elevation of a fuse assembly for an explosive cutting device in accordance with the present invention; and FIG. 2 is a pictorial view of the device of FIGS. 1A and 1B to a smaller scale.

In the drawings, the fuse assembly has two fuses, each of mild detonating fuse (MDF) 10 and 11 of mutually equal length. The fuse 10 extends through a relatively long centre tube 12 while the fuse 11 is formed to an open-coiled helical configuration and is disposed within a relatively short tube or casing 13 being "potted" therein using a silicon rubber material 14 such as Silguard 170. The centre tube 12 extends through the casing 13 which is held between an end clamp 15 and one of two pellet clamps 16. These clamps are generally of disc-like configuration and are provided with screw locking means for locating the clamps on the centre tube 12. The end clamp 15 at the outer end of the casing 13 is provided with an aperture 15A for admitting the potting material 14 in liquid state which later sets to prevent sympathetic detonation from coil to coil of the fuse 11. Also, the end clamp 15 carries a first booster 17 into which one end of each of the fuses 10 and 11 is inserted. Each of the MDF fuses is encased in heat-shrink tubing.

The other end of the fuse 10 extends beyond the centre tube 12 and lies free until the fuse assembly is prepared for detonation in a charge. The other pellet clamp 16 is locatable at any position on the centre tube 12 by means of a screw threaded locking means (not shown). The "travelling" pellet clamp 16 carries a second booster 18 into which the free end of the fuse 10 may be inserted when required as is illustrated by the chain dotted line indicated by reference numeral 10 in FIG. 1B. The other end of the fuse 11 is inserted into a third booster 19 carried in the pellet clamp 16 adjacent the casing 13.

The fuse assembly so far described above may be regarded as a standard assembly capable of holding different numbers of annular pellets of explosive material arranged on the centre tube 12 to form packs of different lengths according to instant requirements. In the drawings, a pack of annular pellets is represented by the broken lines 20.

In order to complete assembly of an explosive charge, the number of annular pellets of explosive material is assessed and that number is placed on the centre tube 12 and clamped in position by means of the outer of the pellet clamps 16. If the relatively small number of pellets is required, the centre tube 12 may be trimmed to a shorter length by means of a wheel-type pipe cutter without damaging the fuse 10 the length of which must not be altered. Thereafter, the end of the fuse 10 is inserted into the booster 18 as shown in FIG. 2. Thereafter, the fuse assembly with the explosive pellets is inserted into an outer casing (not shown).

A single initiation system is applied to the booster 17. When the initiation system is fired, the fuse ends in the booster 17 are set off simultanteously and the MDF 10 and 11, being the same length, determine that the boosters 18 and 19 will detonate the pack 20 simultaneously at the opposite ends thereof.

A typical fuse assembly will have a nominal diameter of the order of 50 mm. The centre tube will be made of stainless steel, and the casing for the coiled fuse and the clamps will be made of aluminium.

I claim:

1. A device for parting or cutting a tube by means of an explosive charge, comprising a pack of explosive pellets and a fuse assembly having two mutually equal lengths of detonating fuse of which one extends through the said pack and the other is disposed at one end of the pack, said one fuse extending between a first booster adjacent but not contiguous with said one end of the pack and a second booster at the other end of the pack, said other fuse extending between the first and a third booster at said one end of the pack, whereby simultaneous detonation of the pack at its opposite ends is achieved by application of a single initiation system to said first booster.

2. A device according to claim 1, wherein said other detonating fuse is arranged in an open-coiled helix configuration.

3. A device according to claim 2, wherein the fuse assembly comprises a relatively short tube housing said helix, and a relatively long tube extending through and beyond the short tube and carrying said one fuse.

4. A device according to claim 1, wherein the second and third boosters are carried by respective clamp members of disc-like configuration and which are located on said relatively long tube.

5. A method of assembling a device for parting or cutting a tube by means of an explosive charge, said method comprising the steps of positioning one end of a relatively long tube inside and along the length of a relatively short tube, whereby said short tube is of substantially larger diameter than said long tube, disposing a first detonating fuse in an open-coiled helical configuration inside the relatively short tube, whereby one end of said first detonating fuse is inserted in a first booster at an inner end of said relatively short tube and the other end of said first detonating fuse is inserted in a second booster at an outer end of said relatively short tube, disposing a second detonating fuse having the same length as said first detonating fuse generally inside said relatively long tube, whereby one end of said second detonating fuse is inserted in said first booster at an inner end of said relatively short tube and the other end of said second detonating fuse extends freely out of the end of said relatively long tube opposite said relatively short tube, disposing a third booster carried by a clamp member locatable at positions spaced along the relatively long tube, disposing a pack of explosive pellets axially on the relatively long tube and locating said clamp member to retain said pack, and inserting said free end of second detonating fuse into said third booster.

6. A fuse assembly for use in a device for parting or cutting a tube by means of an explosive charge, comprising two mutually equal lengths of detonating fuse of which one extends between a first booster and a second booster and the other extends between said first booster and a third booster, said second and third boosters being spaced from each other to receive therebetween, a pack of explosive pellets and an initition system connected to said first booster.

7. A device according to claim 2, wherein the second and third boosters are carried by respective clamp members of disc-like configuration and which are located on said relatively long tube.

8. A device according to claim 3, wherein the second and third boosters are carried by respective clamp members of disc-like configuration and which are located on said relatively long tube.

* * * * *